United States Patent [19]

Nishimiya

[11] 4,335,878

[45] Jun. 22, 1982

[54] GAME HAVING RECIPROCALLY MOVING INTERFERENCE MEMBERS

[75] Inventor: Toru Nishimiya, Tokyo, Japan

[73] Assignee: Tomy Kogyo Co., Inc., Tokyo, Japan

[21] Appl. No.: 149,041

[22] Filed: May 12, 1980

[51] Int. Cl.[3] ..... A63D 3/02

[52] U.S. Cl. ..... 273/119 R; 273/127 D; 273/DIG. 26; 273/369

[58] Field of Search ..... 273/119 R, 354, 369, 273/119 A, 127 D, DIG. 26

[56] References Cited

U.S. PATENT DOCUMENTS

| | | | |
|---|---|---|---|
| 1,510,949 | 10/1924 | McKinnon | 273/119 R |
| 3,358,997 | 12/1967 | Belz | 273/89 |
| 3,477,714 | 11/1969 | Garlington | 273/369 X |
| 3,588,110 | 6/1971 | Hirach | 273/119 R |
| 3,794,318 | 2/1974 | Holmes | 273/354 |
| 3,817,529 | 6/1974 | Dobbins | 273/119 R X |
| 3,853,324 | 12/1974 | Reiner et al. | 273/119 A X |
| 3,865,377 | 2/1975 | Cooper et al. | 273/119 R X |
| 3,927,884 | 12/1975 | Glass et al. | 273/119 R |
| 3,997,163 | 12/1976 | Cooper et al. | 273/121 A |
| 4,244,572 | 1/1981 | Hatakeyama | 273/119 A X |

*Primary Examiner*—George J. Marlo

*Attorney, Agent, or Firm*—K. H. Boswell; Edward D. O'Brian

[57] ABSTRACT

A game of the type having a playing surface enclosed in a housing and including a launching mechanism for propelling an object across the playing surface is improved by locating a target on the playing surface distal from the object launcher and interspacing between the target and the object launcher an interference member. The game includes an actuation device which continually moves the interference member reciprocally back and forth in the path of the object. The interference member is capable of assuming at least one position wherein it can interfere with the movement of the object and at least one position wherein it does not interfere with movement of the object rendering it possible for the object to travel from the object launcher to the target.

The interference member includes a first sliding member having a plurality of projections which move through channels in the playing surface as the first sliding member slides in the housing. The actuation device includes a second sliding member which is biased by a spring from an energized position to a rest position and transfers its movement via gears and a rack and pinion to the first sliding member. The second sliding member is activated by moving a knob attached to it. At least a portion of the target is capable of being moved by the object when struck by the object. The target is further associated with an indicator wheel which tallies the number of times the movable portion of the target has been moved by being struck by the object.

14 Claims, 5 Drawing Figures

GAME HAVING RECIPROCALLY MOVING INTERFERENCE MEMBERS

BACKGROUND OF THE INVENTION

This invention is directed to a game of the type wherein an object is launched across a playing surface. The game includes a target and an interference member capable of interfering with movement of the object towards the target.

Games which utilize objects such as spherical balls are quite popular in that many adaptations can be made to these games which serve to make the games both interesting to the player yet challenging to his manipulation skills. Certain of these type games are susceptible to locating within a housing an object launcher on a playing surface and a target distal from the object launcher. The launcher is then used to propel the object toward the target. Many variations of this type of game have been invented.

One of the variations that is possible is movement of the target across the playing surface or between exposed and protected positions. If the target is movable the object launcher must also be movable to allow proper aiming of the object toward the target. An example of a moving target type game would be the typical penny arcade shooting gallery or an electronic equivalent of the same. Other examples include the game described in U.S. Pat. No. 3,588,110 wherein a moon shaped target moves in an arc and an object is launched from a rotating object launcher. U.S. Pat. No. 3,997,163 describes a game wherein the plurality of targets pop up and down in an apparent random sequence requiring the object launcher to be pivotally mounted on the playing surface such that the player of the game can direct the object to whatever target is in an exposed position.

U.S. Pat. No. 3,927,884 describes a game which incorporates both the movable target idea and the exposed-protected target idea. In this game a plurality of targets are located on a rotating disk. If the targets are hit they move from an exposed position to a protected position.

In another type of game simulating a baseball game as described in U.S. Pat. No. 3,358,997 two players play against each other, the first player attempts to strike the object with a bat and if he successfully does so the second player attempts to capture the object with a movable capture mechanism representing the positions of the defensive players on a baseball field.

These type of games have been improved by incorporating a stationary interference member in the pathway of the object between the object launcher and the target. One such game is described in U.S. Pat. No. 3,865,377. Because of the presence of this stationary interference member the player cannot shoot directly at the object but must rely on his ability to deflect the object off of bumpers towards the target.

It is considered that the type of game wherein an object is directed towards a target by an object launcher could be improved with regards to both maintaining the interest of a player and requiring perfection of his coordination skills by placing a movable interference member in the pathway of the object.

BRIEF SUMMARY OF THE INVENTION

In view of the above it is an object of this invention to provide a game wherein a movable interference member is placed in the pathway an object must travel between an object launcher and a target. It is a further object to provide such a game which is of sufficient small scale such that it is portable and can easily be tucked away into purse or pocket for use at any desired time. It is a further object to provide a game that is engineered such that it is reliable in operation yet is economical to produce.

These and other objects as will become evident from the remainder of this specification are achieved by providing a game of the type having a housing, a playing surface located in the housing and an object propulsion means associated with said playing surface for propelling an object across said playing surface which comprises: a target means located in association with said playing surface; an interference means movably mounted in said housing, at least a portion of said interference means associated with said playing surface, said portion of said interference means movable on said playing surface in an area located between said target and said object propulsion means; activation means for continuously moving said portion of said intereference means associated with said playing surface; said interference means moving between at least one position wherein said portion of said interference means associated with said playing surface is capable of inhibiting the movement of said object between said object propulsion means and said target and at least one position wherein said portion of said interference means associated with said playing surface does not inhibit the movement of said object between said object propulsion means and said target means.

Preferably the interference means is capable of continuously moving in a reciprocal manner and including a plurality of upstanding projections spaced apart from one another such that a series of pathways are formed in between the upstanding projections. Further, an indicating means is associated with the target means to provide an indication that the object has struck the target.

Preferably the interference means includes a first sliding member slidably mounted on the housing and has a plurality of upstanding projections located on it such that the projections are capable of projecting through channels in the surface of the playing surface to position a portion of the projections above the playing surface in positions wherein they are capable of interfering with the travel of the object. The activation means includes an energizing means movably mounted on the housing between a rest position and an energized position and having transfer means operatively connecting it to the first sliding member such that the first sliding member moves in response to movement of the energizing means. The energizing means preferably includes a second sliding member which is biased from said energized position to said rest position and transfers its movement via gears and a rack and pinion means to said first sliding member.

BRIEF DESCRIPTION OF THE DRAWINGS

This invention will be better understood when taken in association with the drawings wherein.

Figures 1, 2:
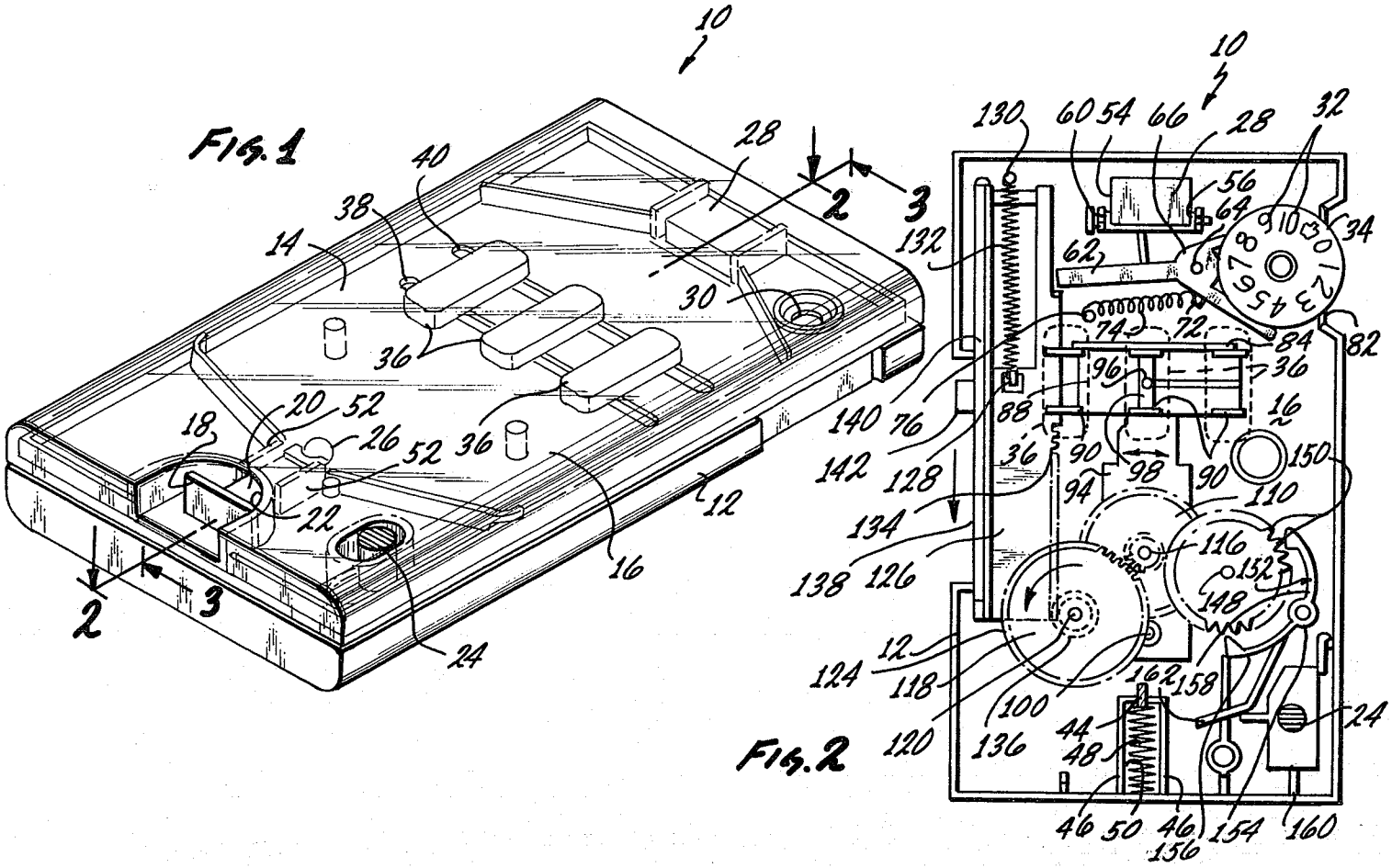
FIG. 1 is an isometric view of the preferred embodiment of the invention.
FIG. 2 is a top plan view about the line 2—2 of FIG. 1 showing internal mechanisms of the game.

The invention illustrated in the drawings and described in this specification utilizes certain principles and concepts as are set forth and defined in the claims appended to this specification. Those skilled in the arts to which this invention applies will realize that these principles and concepts could be utilized with a number of differently appearing embodiments without departing from the spirit or scope of the claims. It is for this reason that this invention is to be construed in light of the claims appended hereto and is not to be construed as being limited to the exact embodiment herein described and illustrated.

DETAILED DESCRIPTION

The game 10 of the invention is contained in lower housing member 12 and clear upper housing member 14. Located between the two housing members 12 and 14 is a playing surface 16. The playing surface 16 is appropriately supported above the lower housing 12 by certain support members not identified or numbered which are integrally formed with the lower housing 12.

Referring to FIG. 1 in the bottom of the game 10 is an object launcher 20 having a finger grip 18. The upper housing 14 includes an arc-like indent 22 allowing the user of the game to manipulate the object launcher 20 with one of his fingers. To the right of object launcher 20 is an off and on button 24. An object 26 is shown in position on the object launcher 20. On the opposite end of the game 10 is a target 28. To the right of target 28 is a window 30 allowing viewing of one of the indicia 32 located on an indicator wheel 34. Positioned on the playing surface 16 between the target 28 and the object launcher 20 are three rectangular blocks 36 which are capable of interfering with the travel of the object 26 toward the target 28. Located beneath the blocks 36 are two channel openings 38 and 40 in the playing surface 16. As will later be described, certain projections, not at this time numbered or identified, project upwardly through the openings 38 and 40 into the bottom of blocks 36 and move blocks 36 across playing surface 16. The object 26 is sized to fit between the spaces of the blocks 36 and in order to strike the target 28 the object 36 must be safely moved through these spaces.

An opening 42 is located through playing surface 16 below object launcher 20. A boss 44 projects from the bottom of object launcher 20 through opening 42. Formed on the inside of lower housing 12 are two "L" shaped upstanding projections 46 which form a chamber (not numbered) for a spring 48. The boss 44 fits within the opening 50 between projections 46 against spring 48. When the object launcher 20 is moved to the rear of the game as shown in phantom lines in FIG. 3 the boss 44 compresses spring 48. When the object launcher 20 is released it is propelled forward to the position shown in solid lines in FIG.3 and in so doing is capable of propelling the object 26 toward the target 28. The object launcher 20 is guided in a straight path by the position of the boss 44 in the opening 42 as well as two upstanding projections collectively identified by the numeral 52 which project upwardly from the playing surface 16 forming a channel, not numbered, for the object launcher 20 to move in.

Moving now to the other end of the game, the target 28 is part of a target member 54 which includes a bearing surface 56. An axle 58 passes through the bearing surface 56 and is supported by two upstanding bifurcated projections 60 supporting the target member 54 in a manner allowing it to pivot to the position shown in phantom lines in FIGS. 3 and 5 when it is struck by the object 26.

Figures 3, 4, 5:
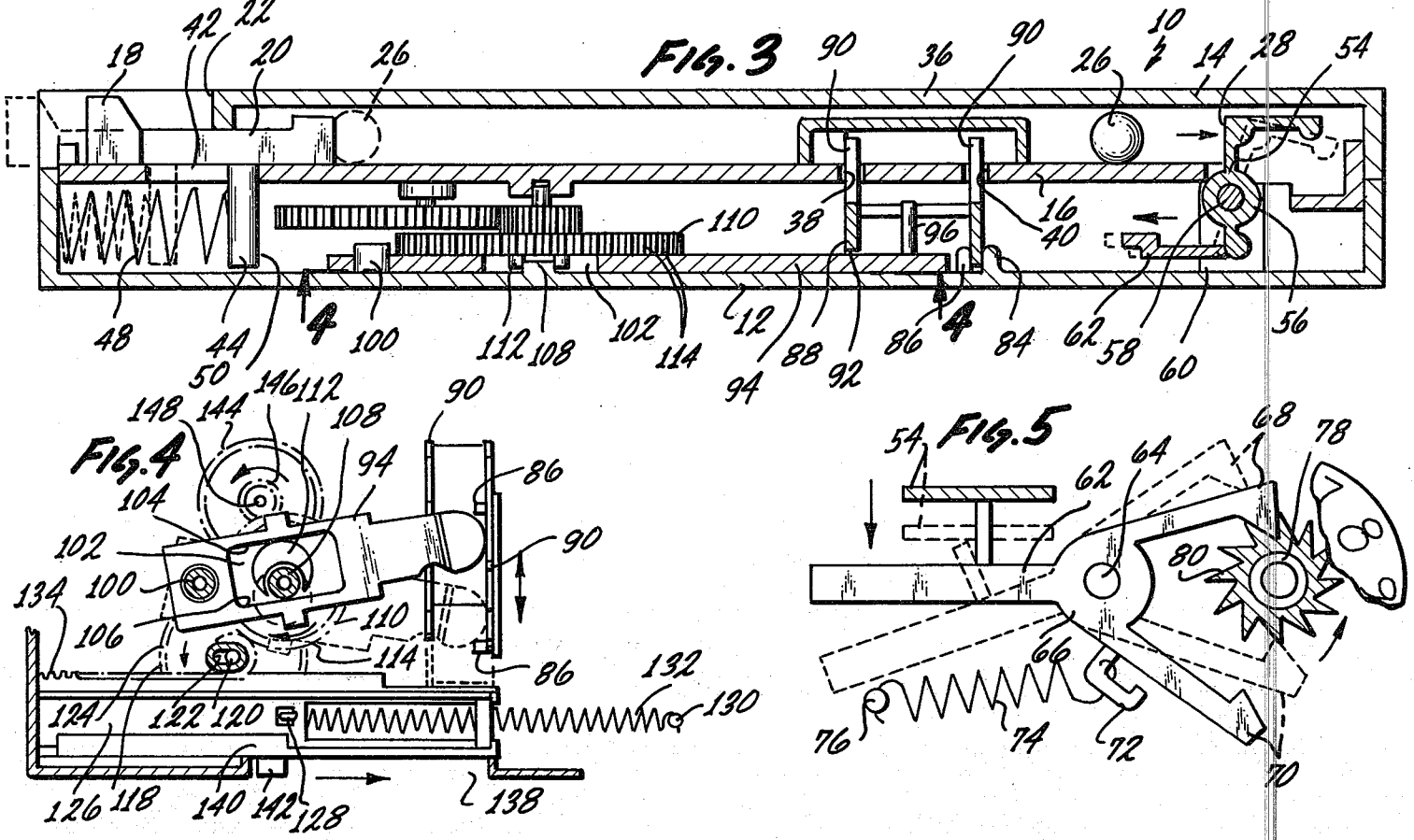
FIG. 3 is a side elevational view in partial section about the line 3—3 of FIG. 1.
FIG. 4 is a bottom plan view in section about the line 4—4 of FIG. 3.
FIG. 5 is a top elevational view showing certain components located in the upper right hand corner of FIG. 2 which lie underneath overlaying components shown in FIG. 2 but not shown in FIG. 5.

The target member 54 is maintained in the upright position shown in solid lines in FIGS. 3 and 5 by motion transfer lever 62. A boss 64 projects upwardly from lower housing 12. Transfer lever 62 contains a bearing surface 66 which fits around boss 64 pivotally mounting motion transfer lever 62 to lower housing 12. The transfer lever 62 contains two escapement arms 68 and 70. Escapement arm 70 has a hook 72 formed thereon to which one end of spring 74 is attached. The other end of spring 74 attaches to an upstanding boss 76 projecting upwardly from lower housing 12. Spring 74 biases transfer lever 62 clockwise as shown in solid lines in FIG. 5. The transfer lever 62 abuts against target member 54 maintaining target member 54 in its upright position as shown in solid lines in FIG. 3. When target member 54 is tilted by the object member its motion is transmitted to transfer lever 62 moving it to the position shown in phantom lines in FIG. 5 and stretching spring 74. Thus the momentum of the object 26 transfers to spring 74 stretching it and when spring 74 returns to its unstretched position it rotates target member 54 back to the position shown in solid lines in FIG. 3.

Indicator wheel 34 is rotatably mounted about a boss 78 projecting upwardly from lower housing 12. integrally formed on the underside of indicator wheel 34 are escapement ratchet teeth 80. The teeth 80 interact with escapement arms 68 and 70 in the usual manner for an escapement mechanism. Each time the transfer lever 62 is moved between the positions shown in solid and phantom lines in FIG. 5 the escapement arms 68 and 70 move indicator wheel 34 counterclockwise such that the indicia 32 located on the surface of indicator wheel 34 are stepwise moved past the window 30. A portion of the right hand side of indicator wheel 34, no matter what its position about boss 78, is exposed through opening 82 in the right hand side of lower housing 12. This allows the player of the game to reset the indicator wheel 34 such that the indicia zero can be located underneath window 30 at the start of each game.

Projecting upwardly from lower housing 12 are guide flanges 84 and 86. Slidably located on lower housing 12 is interference sliding member 88. One of the edges, not numbered, of interference sliding member 88 fits between the guide flanges 84 and 86 such that the sliding movement of the member 88 is confined to a straight path transverse to the longitudinal axis of the toy 10. A plurality of projections 90 project upwardly from the surface of member 88 through channels 38 and 40. Each of the blocks 36 fit over two of these projections 90 in such a manner that the blocks are fixedly held in respect to the relationship with one another maintaining the spaces between the blocks 36. The other of the edges, also not numbered, of sliding member 88 has a small cutout 92 in its surface such that pivot member 94 can fit underneath this edge.

Pivot member 94 has an upstanding boss 96 on one of its ends which fits within slot 98 formed in sliding member 88. The other end of pivot member 94 is pivotal around boss 100. The interior of pivot member 94 has a rectangular shaped cutout 102, the walls of which form cam follower surfaces 104 and 106. A boss 108 projects upwardly through the center of cutout 102 from lower housing 12. Mounted over boss 108 is a gear 110 having a cam 112 eccentrically located on its underneath side. Cam 112 fits within rectangular hole 102 and interacts with the cam follower surfaces 104 and 106. Rotation of gear 110 thus causes pivot member 94 to oscillate back and forth about boss 100. This oscillating motion is transferred to a reciprocal back and forth motion of sliding member 88. The reciprocal back and forth motion of sliding member 88 causes blocks 36 to move back and forth such that in certain positions of the sliding member 88 the spaces between the blocks 36 form pathways between the object launcher 20 and the target 28 and in certain other positions of the sliding member 38 the blocks 36 inhibit the pathway of the object 26 between the object launcher 20 and the target 28.

Gear 110 has a set of spur teeth 114 around its periphery and a pinion 116 on its upper surface. Located to the left hand side of gear 110 is gear 118. Gear 118 has an axle 120 passing through its center. The axle 120 is mounted in slots 122, one located on lower housing 12 and one located on the bottom of playing surface 16. This allows gear 118 to slide back and forth and in one position spur teeth 124 located around its periphery mesh with pinion 116 on gear 110 and in a second position the gear 118 is slid backwards such that its spur teeth 124 are withdrawn from engagement with pinion 116.

Within the interior of the lower housing 12 on the left hand side is activation sliding member 126. On the upper surface of member 126 is a small hook 128. Projecting upwardly from lower housing 12 is a boss 130. A spring 132 stretches between boss 130 and hook 128 biasing sliding member 126 in a direction toward the target 28. Located on the right hand side of sliding member 126 is a rack of gears 134. The rack of gears 134 mesh with pinion 136 located on gear 118.

A cutout 138 extends along the left hand side of the lower housing 12. Positioned between the cutout 138 and sliding member 126 is reset member 140. Reset member 140 has a button 142 which can be manipulated by the player's fingers. A knob 142 projects out of the left hand side of sliding member 126. When reset member 140 is slid toward the end of the game 10 wherein the object launcher is located it abuts against knob 142 sliding member 126 against the bias of spring 132. As this happens the rack of gears 134 intermeshing with the pinion 136 slides gear 118 away from its engagement with gear 110. When sliding member 126 is completely depressed toward the end of game 10 wherein the object launcher is located and the player releases the reset member 140 the spring 132 biases sliding member 126 back in the other direction. This slides gear 118 in the slots 122 until its spur teeth 124 engage pinion 116. Further movement of sliding member 126 toward the end of the game 10 wherein the target is located is transferred via gear 118 to gear 110 which, from the interaction of parts noted before, will cause pivot member 94 to oscillate and sliding member 88 to slide reciprocally back and forth across the transverse axis of the game. The sliding member 88 will maintain its back and forth movement until the spring 132 has completely returned sliding member 126 to the position shown in FIG. 2.

In FIG. 2 the sliding member 126 could be described as being in a rest position. In FIG. 4 it could be described as being in an energized position. The movement of gear 118 in slot 122 acts as a clutch in that it transfers movement from the sliding member 126 to the sliding member 88 as sliding member 126 moves from its energized position to its rest position but does not transfer movement as the sliding member 126 moves from its rest position to its energized position.

A third gear 144 is located to the right of gear 110. It has a pinion 146 located on its bottom side. Pinion 146 meshes with spur teeth 114 of gear 110 thus transferring rotation of gear 110 to gear 114 causing it to rotate about its axle 148 which is appropriately mounted in bearing surfaces, not identified or numbered, in the lower housing 12 and in the bottom of playing surface 16. A set of ratchet teeth 150 extend around the perimeter of gear 144. Located to the right of gear 144 is escapement arm 152. Escapement arm 152 is pivotally mounted about boss 154 located in lower housing 12. The escapement arm 152 has arms 156 and 158 which interact with the ratchet teeth 150 in the usual manner associated with an escapement movement. The escapement movement between escapement arm 152 and ratchet 150 governs the speed of rotation of gear 110 which in turn by the interaction of other parts noted above governs the speed of the reciprocal movement of the sliding member 88.

Off/on button 24 has two slots in its lower surface, not numbered or seen, allowing off/on button 24 to slide back and forth about upstanding flange 160 located in lower housing 12. The escapement arm 152 has a third arm 162 which is positioned to interact with off/on button 24. When off/on button 24 is pushed toward the end of the game 10 wherein target 28 is located it interacts with arm 162 freezing the escapement arm 152 in position locking it with ratchet teeth 150. This prevents rotation of gear 144, gear 110 and gear 118. When gear 110 is fixed sliding member 126 cannot move between the energized position to the rest position, however, it can move from the rest position to the energized position because of the clutch action of gear 118 in slots 122.

To play the game the player of the game places the off/on switch in the off position and energizes the game by sliding reset member 140 toward the end of the game 10 wherein the object launcher 20 is located. The off/on button 24 is then pushed to the on position and the player uses the object launcher 20 to propel the object 26 toward the target. The player attempts to hit the target 28 as many times as possible during the time period it takes for sliding member 126 to return to its rest position. During this time the blocks 36 are moving reciprocally side to side at a constant rate which is governed by the interaction of escapement arm 152 with ratchet teeth 150. The number of times the player successfully hits the target 28 is accumulated on the indicator wheel 34 by the advancement of the indicia 32 beneath the window 30. When the sliding member 126 has reached its rest position the blocks 36 cease to move and the game is over. The player then notes his score in the indicator window 30. After resetting the zero indicia underneath the indicator window 30 the game is ready to be played again.

I claim:

1. A game of the type having a housing, a playing surface located in the housing and an object propulsion means associated with said playing surface for propelling an object across said playing surface which comprises:

a target means located in association with said playing surface, at least a portion of said target means being movable between a first position and a second position, said movable portion of said target means moving from said first position to said second position upon being contacted by said object means;

an interference means movably mounted in said housing, at least a portion of said interference means associated with and projecting upwardly from said playing surface, said portion of said interference means movable on said playing surface in an area located between said target means and said object propulsion means;

activation means for continuously moving said portion of said interference means associated with said playing surface;

said interference means moving in response to said activation means between at least one position wherein said portion of said interference means associated with said playing surface is capable of inhibiting the movement of said object between said object propulsion means and said target means and at least one position wherein said portion of said interference means associated with said playing surface does not inhibit the movement of said object between said object propulsion means and said target means.

2. The game of claim 1 wherein:

said interference means is capable of reciprocally moving with respect to said housing such that said portion of said interference means associated with said playing surface alternately moves between said position inhibiting movement of said object and said position not inhibiting movement of said object.

3. The game of claim 2 wherein:

said portion of said interference means associated with said playing surface includes a plurality of upstanding projections spaced apart from one another by a distance which is greater than the dimensions of said object such that said object is capable of moving between each two adjacent members of said plurality of projections when said interference means is in said position not inhibiting the movement of said object between said object propulsion means and said target means allowing said object to travel from said object propulsion means to said target means along a pathway which includes traveling between said two adjacent members.

4. A game of the type having a housing, a playing surface located in the housing and an object propulsion means associated with said playing surface for propelling an object across said playing surface which comprises:

a target means located in association with said playing surface;

an interference means movably mounted in said housing, at least a portion of said interference means associated with said playing surface, said portion of said interference means movable on said playing surface in an area located between said target means and said object propulsion means;

activation means for continuously moving said portion of said interference means associated with said playing surface;

said interference means moving between at least one position wherein said portion of said interference means associated with said playing surface is capable of inhibiting the movement of said object between said object propulsion means and said target means and at least one position wherein said portion of said interference means associated with said playing surface does not inhibit the movement of said object betwen said object propulsion means and said target means;

said interference means is capable of reciprocally moving with respect to said housing such that said portion of said interference means associated with said playing surface alternately moves between said position inhibiting movement of said object and said position not inhibiting movement of said object;

said portion of said interference means associated with said playing surface includes a plurality of upstanding projections spaced apart from one another by a distance which is greater than the dimensions of said object such that said object is capable of moving between each two adjacent members of said plurality of projections when said interference means is in said position not inhibiting the movement of said object between said object propulsion means and said target means allowing said object to travel from said object propulsion means to said target means along a pathway which includes traveling between said two adjacent members;

said target movably mounted on said housing and capable of being moved when struck by said object;

indicating means located in association with said target means and capable of indicating when said object strikes said target.

5. The game of claim 4 wherein:

said interference means includes a first sliding member slidably mounted on said housing below said playing surface such that it is capable of sliding reciprocally in said housing, said plurality of upstanding projections located on said sliding member, said playing surface including channel means, said projections projecting through said channel means positioning a portion of each of said projections above said playing surface.

6. The game of claim 5 wherein:

said activation means includes an energizing means capable of being energized and transfer means operatively connected to both said energizing means and said first sliding member to cause said sliding member to slide in said housing in response to said energizing means.

7. The game of claim 6 wherein:

said energizing means includes a second sliding member slidably mounted on said housing between a rest position and an energized position and biasing means operatively attaching to said second sliding member biasing said second sliding member from said energized position to said rest position;

said transfer means operatively connected to said second sliding member such that said first sliding member moves reciprocally in said housing as said second sliding member moves from its energized position to its rest position.

8. The game of claim 7 wherein:

said second sliding member includes a rack of gears located on a portion of it;

said transfer means includes gear means mounted on said housing, said rack of gears on said second sliding member interacting with said gear means;

said transfer means includes a pivot member pivotally mounted on said housing, said pivot member operatively connected to said first sliding member, said pivot member including cam follower means;

said transfer means including cam means operatively associated with said gear means and said cam follower means transferring motion from said gear means to said pivot member.

9. The game of claim 8 including:

regulatory means operatively connected to said gear means regulating the speed of movement of said gear means.

10. The game of claim 9 wherein:

said regulatory means includes a first escapement means and said gear means includes a first ratchet means, said first escapement means operatively associated with said first ratchet means to control the speed of rotation of said gear means.

11. The game of claim 10 wherein:

said indicating means includes an indicator wheel having a plurality of indicia thereon and an indicator wheel rotation means operatively associated with both said indicator wheels and said target means such that said indicator wheel rotates with respect to movement of said target means;

said indicator wheel rotation means includes a motion transfer lever pivotally mounted in said housing and operatively associated with said target means, said motion transfer lever including a second escapement means, said indicator wheel including a second ratchet means, said second escapement means operatively associated with said second ratchet means, movement of said target means transferred to said indicator means by said motion transfer lever, said second escapement means and said second ratchet means;

and including a control button operatively associated with said first escapement means and capable of fixing movement of said first escapement means inhibiting movement of said gear means.

12. The game of claim 4 wherein:

said indicating means includes an indicator wheel having a plurality of indicia thereon and an indicator wheel rotation means operatively associated with both said indicator wheels and said target means such that said indicator wheel rotates with respect to movement of said target means.

13. The game of claim 12 wherein:

said indicator wheel rotation means includes a motion transfer lever pivotally mounted in said housing and operatively associated with said target means, said motion transfer lever including a second escapement means, said indicator wheel including a second ratchet means, said second escapement means operatively associated with said second ratchet means, movement of said target means transferred to said indicator means by said motion transfer lever, said second escapement means and said second ratchet means.

14. The game of claim 12 including:

clutch means operatively associated with said gear means, said clutch means operatively connecting said gear means with said rack of gears when said second sliding member moves from said energized position to said rest position and disconnecting said gear means from said rack of gears when said second sliding member moves from said rest position to said energized position.

* * * * *